US010053944B2

(12) United States Patent
Cohen

(10) Patent No.: US 10,053,944 B2
(45) Date of Patent: Aug. 21, 2018

(54) RISER RESTRICTOR DEVICE

(71) Applicant: ENHANCED DRILLING AS, Straume (NO)

(72) Inventor: John H. Cohen, Houston, TX (US)

(73) Assignee: ENHANCED DRILLING AS, Straume (NO)

( * ) Notice: Subject to any disclaimer, the term of this patent is extended or adjusted under 35 U.S.C. 154(b) by 24 days.

(21) Appl. No.: 14/912,516

(22) PCT Filed: Aug. 12, 2014

(86) PCT No.: PCT/NO2014/050144

§ 371 (c)(1),
(2) Date: Feb. 17, 2016

(87) PCT Pub. No.: WO2015/026240

PCT Pub. Date: Feb. 26, 2015

(65) Prior Publication Data

US 2016/0201426 A1 Jul. 14, 2016

(30) Foreign Application Priority Data

Aug. 19, 2013 (NO) ..... 20131122

(51) Int. Cl.
*E21B 33/12* (2006.01)
*E21B 17/10* (2006.01)
(Continued)

(52) U.S. Cl.
CPC ..... *E21B 33/12* (2013.01); *E21B 17/01* (2013.01); *E21B 17/10* (2013.01); *E21B 21/08* (2013.01)

(58) Field of Classification Search
CPC ..... E21B 17/01; E21B 17/10; E21B 21/08; E21B 33/12
See application file for complete search history.

(56) References Cited

U.S. PATENT DOCUMENTS 1,965,998 A * 7/1934 Williams ..... E21B 17/105 175/325.6
7,096,940 B2 * 8/2006 Baxter ..... E21B 17/1085 166/241.6
(Continued)

FOREIGN PATENT DOCUMENTS

GB 306700 A 2/1929
GB 2502626 A 12/2013
(Continued)

*Primary Examiner* — James G Sayre
(74) *Attorney, Agent, or Firm* — Foley & Lardner LLP

(57) ABSTRACT

A restrictor device for controlling a return flow of drilling fluid from a borehole where drilling fluid is provided from a surface installation via a drill string to a bottom-hole assembly is disclosed. Drill pipes forming the drill string are provided with pipe joints including enlarged-diameter pipe portions. An annulus is formed between a riser and the drill string. The annulus is in fluid communication with a drilling-fluid flow path. The restrictor device is arranged in the annulus. The restrictor device includes a restrictor pipe anchored to the riser and surrounds at least one restrictor element placed on an intermediate pipe portion that connects two enlarged-diameter pipe portions. The length of the restrictor device exceeds the largest distance between two consecutive restrictor elements. The restrictor element is a drill-pipe/casing protector with an external diameter larger than a diameter of the pipe joints.

7 Claims, 1 Drawing Sheet

(51) Int. Cl.
*E21B 21/08* (2006.01)
*E21B 17/01* (2006.01)

(56) References Cited

U.S. PATENT DOCUMENTS

2004/0069504 A1 4/2004 Krueger et al.
2005/0082056 A1* 4/2005 Baxter ..... E21B 17/1085
166/241.6

FOREIGN PATENT DOCUMENTS

WO WO 2013/055226 A1 4/2013
WO WO 2013055226 A1 * 4/2013 ..... E21B 21/08

* cited by examiner

RISER RESTRICTOR DEVICE

BACKGROUND

A restrictor device controls a return flow of drilling fluid from a borehole where drilling fluid is provided from a surface installation via a drill string to a bottom-hole assembly. Drill pipes, forming the drill string, are provided with pipe joints including enlarged-diameter pipe portions. An annulus is formed between a pipe, for example a marine riser, and the drill string, and the annulus is in fluid communication with or forms parts of a drilling-fluid flow path. The restrictor device is arranged in the annulus, the restrictor device being formed of a restrictor pipe, anchored to said riser, and surrounding at least one restrictor element placed on an intermediate portion connecting two enlarged-diameter pipe portions. The length of the restrictor device exceeds the largest distance between two consecutive restrictor elements.

It is known to install drill-pipe/casing protectors (DPPs) externally on a drill string to prevent undue wear on the internal wall of the casing owing to the rotation of the drill string. The DPP, which is formed as cylindrical, dividable pads, typically formed from steel-reinforced rubber, is fitted to desired portions of the drill string as it is being built up, the two halves being locked to each other by means of locking pins.

From the applicant's own patent application PCT/NO2012/050187 a choke is known, arranged externally on a drill string, the length of the choke exceeding the distance between the enlarged joint portions of two consecutive drill pipes. The choke is placed in and attached to a riser. The purpose of the choke is to restrict a portion of the annulus in the riser above a return path for a drilling fluid in the form of a drilling-fluid return branch in the riser, where a drilling-fluid return line including a return-fluid pump is extended parallel to the riser to a surface installation. The annulus pressure below the choke, and thereby the bottom-hole pressure, may then be adjusted by controlling the capacity of the return-fluid pump, without any adjustment of the fluid column in the riser being necessary. The annulus pressure can thereby quickly be adjusted to the bottom-hole pressure requirement arising on a change between circulation and non-circulation in the drilling-fluid flow.

A problem with other prior art—in which the fluid column is reduced—is that when circulation ceases and, with that, there is a loss of frictional pressure in the borehole, the bottom-hole pressure could drop below the formation pressure so that well fluid starts to enter the borehole (well kick).

A drawback of the choke according to PCT/NO2012/050187 is that it represents a cer-tain risk of wear to the joint portions of the drill string because of the limited clearance, which is preferably in the range of 1.5-3 mm. Another drawback is that the diameter of the joint portions may vary somewhat, which gives variation in the choking effect and thereby variation in the leakage past the choke. The leakage will necessarily have to be overcome by the return-fluid pump and is thus lost energy and pump capacity, which could otherwise have been used for circulation through the borehole.

The applicant's own patent application PCT/NO2012/050187 is incorporated in its entirety herein by reference.

SUMMARY

The invention has for its object to remedy or reduce at least one of the drawbacks of the prior art or at least provide a useful alternative to the prior art.

The object is achieved through features, which are specified in the description below and in the claims that follow.

The aim of the invention is to use elements resembling a drill-pipe/casing protector (DPP) as a restrictor element in a restrictor device during a drilling operation. Thereby, greater precision and less variation in the clearance in the restrictor device are achieved than with the use of prior art.

The invention provides a replaceable restrictor device attached in a portion of a marine riser, arranged in an annulus defined by a drill string and the riser, wherein a cylindrical restrictor pipe encloses a portion of the pipe string and preferably is sealingly fixed in a portion of the riser by means of several anchors. The anchoring may be rigid or yielding. The length of the restrictor pipe is formed in such a way that, at all times, at least one restrictor element is completely or partially surrounded by the restrictor pipe and fixed on the portion of the pipe string that extends through the restrictor device when a lower portion of the drill string is in a structure in which there is a need to control a bottom-hole pressure, the restrictor element exhibiting a minimal clearance to the internal wall of the restrictor pipe, possibly being formed with external lip seals so that an approximately full seal is achieved. Thereby the internal diameter of the restrictor pipe may be so large that no contact will occur between the enlarged joint portions and the restrictor pipe.

The device as described above provides a highly restricted flow path for the annulus fluid column present above the restrictor device. The annulus pressure and thus the bottom-hole pressure may thereby be efficiently controlled with the return-fluid pump without any significant loss of pump capacity and energy, as the upper part of the annulus fluid column remains substantially intact and contributes to the full with respect to the static bottom-hole pressure, but to a limited degree to the dynamic bottom-hole pressure, because of a great frictional loss when the drilling fluid is leaking through the restrictor device. Thus, less pumping capacity is required to adjust the bottom-hole pressure.

The restrictor elements may be provided with peripheral channels to provide flow channels of a sufficiently large cross section to supply drilling fluid as a lubricant to the periphery of the restrictor elements in order thereby to reduce friction and wear. In a normal drilling operation, the restrictor elements will pass just once through the restrictor device, so that there is relatively little wear.

Each pipe in the drill string may be provided with a restrictor element near each of the end portions of the pipe.

In a first aspect, the invention relates more specifically to a restrictor device for controlling a return flow of drilling fluid from a borehole where drilling fluid is provided from a surface installation via a drill string to a bottom-hole assembly, drill pipes, forming the drill string, being provided with pipe joints including enlarged-diameter pipe portions, and where an annulus is formed between a pipe, for example a marine riser, and the drill string, and where the annulus is in fluid communication with or forms parts of a drilling-fluid flow path, and where the restrictor device is arranged in the annulus, the restrictor device being formed of a restrictor pipe, anchored to said riser, and including at least one restrictor element placed on an intermediate pipe portion connecting two enlarged-diameter pipe portions, and the length of the restrictor device exceeding the largest distance between two consecutive restrictor elements, characterized by the restrictor element being an element resembling a drill-pipe/casing protector (DPP) with an external diameter that is larger than the diameter of the pipe joints.

A clearance between the restrictor element and the restrictor pipe may be in the range of 0-3 mm.

The restrictor element may be provided with one or more flow channels.

The restrictor element may be provided with one or more lip seals.

The intermediate pipe portion may be provided with a restrictor element arranged in the immediate vicinity of each of the enlarged-diameter portions.

In a second aspect, the invention relates more specifically to the use of a restrictor element resembling a drill-pipe/casing protector (DPP) in a restrictor device for controlling a return flow of drilling fluid from a borehole.

BRIEF DESCRIPTION OF THE DRAWINGS

In what follows, an example of a preferred embodiment is described, which is visualized in the accompanying drawings, in which.

DETAILED DESCRIPTION

Figures 1, 2, 3, 4:
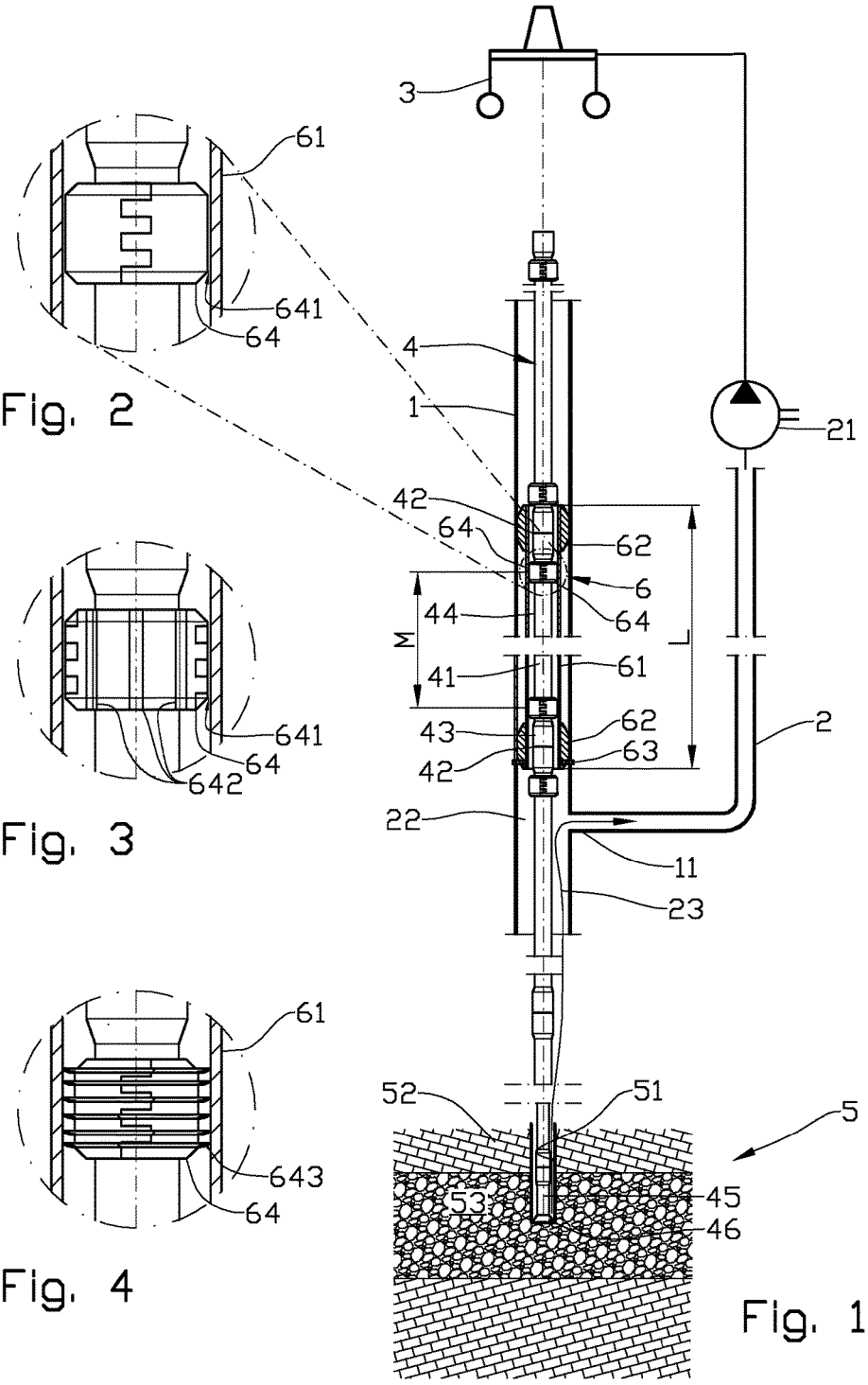
FIG. 1 shows schematically a restrictor device according to the invention arranged in a riser, in which a drilling-fluid return line is connected to an annulus portion upstream of the restrictor device.
FIG. 2 shows an enlarged section of a restrictor element resembling a drill-pipe/casing protector (DPP) arranged on a drill string and surrounded by a restrictor pipe.
FIG. 3 shows, on the same scale as FIG. 2, a variant of a restrictor element provided with peripheral channels arranged in the axial direction.
FIG. 4 shows, on the same scale as FIG. 2, a variant of a restrictor element provided with external sealing lips.

Reference is first made to FIG. 1, in which a marine riser 1 extends from a seabed (not shown) to a surface installation 3 in a manner known per se. The riser 1 is provided with a return branch 11 for the connection of a drilling-fluid return line 2.

The drilling-fluid return line 2 extends from the return branch 11 of the riser 1 to the surface installation 3. Possibly, parts of the drilling-fluid return line 2 may comprise a branch (not shown) that leads into the top of the riser 1. A return-fluid pump 21 is integrated in the drilling-fluid return line 2 which is in fluid communication with an annulus 22 formed between the riser 1 and a drill string 4. The drilling-fluid return line 2, together with the annulus 22, forms a drilling-fluid flow path 23.

The drill string 4 extends in a manner known per se through the riser 1 from the surface installation 3 and through a borehole 51 in an underground formation 5 to a bottom-hole assembly 45. The bottom-hole assembly 45 includes a drill bit 46, which, in FIG. 1, is in a hydrocarbon-containing structure 53, and a so-called well, bordered by a tight formation 52. The drill string 4 is composed of a number of drill pipes 41, each provided with at least one enlarged-diameter pipe-end portion 43 which, together with an opposite pipe-end portion on the adjacent drill pipe 41, forms a pipe joint 42. Extending between the pipe-end portions, there is an intermediate pipe portion 44 with a smaller diameter than the pipe end portion 43. The intermediate pipe portion 44 has a length L.

Internally in an upper portion of the riser 1, a restrictor device 6 is fixed, including a cylindrical restrictor pipe 61 fixed in a fluid-sealing manner to the riser 1 by means of restrictor-pipe anchors 62 and locking devices 63. Together with restrictor elements 64 enclosing portions of the intermediate pipe portions 44 of several drill pipes 41, it forms a clearance 641 between the internal wall surface of the restrictor pipe 61 and the periphery of each restrictor element 64. The clearance is preferably in the range of 0-3 mm. The restrictor elements 64 are preferably positioned near the pipe joints 42, and each of the drill pipes 41 that are to be provided with restrictor elements 64 may, with advantage, be provided with one restrictor element 64 at each pipe joint 42, as it is shown in FIG. 1.

The restrictor elements 64 may be of different external diameters and designs to adapt the clearance 641 for the choking needed in the particular case, for example determined by the drilling-fluid viscosity, formation pressure and so on, that is to say parameters that a person skilled in the art will take into consideration during a drilling operation.

If there is a risk that the clearance 641 may become blocked by cuttings or that there will be too much wear, the restrictor elements may be provided with one or more flow channels 642 as it is shown in FIG. 3. In such an embodiment, the flow channels 642 and the clearance 641 will typically be reduced to a minimum to maintain a desired flow area in the restrictor device 6.

In FIG. 4, an exemplary embodiment is shown, in which the restrictor element 64 is provided with several concentric sealing lips 643 abutting in a substantially sealing manner against the internal wall surface of the restrictor pipe 61.

The invention claimed is:

1. A restrictor device for controlling a return flow of drilling fluid from a borehole where the drilling fluid is provided from a surface installation via a drill string to a bottom-hole assembly, drill pipes forming the drill string being provided with pipe joints including enlarged-diameter pipe portions, and where an annulus is formed between a riser and the drill string, and where the restrictor device is arranged in the annulus, and where the restrictor device defines a drilling-fluid flow path formed by a lower portion of the annulus and a drilling-fluid return line comprising a return-fluid pump, the restrictor device comprising:

at least one restrictor element configured to be placed on an intermediate pipe portion that connects two enlarged-diameter pipe portions; and a restrictor pipe configured to be anchored to the riser and to surround the at least one restrictor element, wherein the length of the restrictor device exceeds the largest distance between two consecutive restrictor elements, and wherein the at least one restrictor element has an external diameter that is larger than the diameter of the pipe joints, forming a clearance between the at least one restrictor element and the restrictor pipe, at least partly isolating a fluid column in an upper portion of the annulus from the drilling-fluid flow path.

2. The restrictor device in accordance with claim 1, wherein the clearance between the at least one restrictor element and the restrictor pipe is in the range of 0-3 mm.

3. The restrictor device in accordance with claim 1, wherein the at least one restrictor element is provided with one or more sealing lips.

4. The restrictor device in accordance with claim 1, wherein the intermediate pipe portion is provided with a restrictor element arranged in the immediate vicinity of each of the enlarged-diameter pipe portions.

5. The restrictor device in accordance with claim 1, wherein the at least one restrictor element is provided with one or more flow channels.

6. A restrictor assembly for controlling a return flow of drilling fluid from a borehole, comprising:

a drill string configured to provide the drilling fluid from a surface installation to a bottom-hole assembly, the drill string being formed by drill pipes connected by pipe joints having enlarged-diameter pipe portions;

a riser that receives the drill string to form an annulus between the riser and the drill string, wherein the annulus is in fluid communication with or forms a part of a drilling-fluid flow path; and a restrictor device comprising:

at least one restrictor element placed on an intermediate pipe portion that connects two enlarged-diameter pipe portions; and a restrictor pipe anchored to the riser and surrounding the at least one restrictor element, wherein the length of the restrictor device exceeds the largest distance between two consecutive restrictor elements, and wherein the at least one restrictor element has an external diameter that is larger than the diameter of the pipe joints, and wherein the at least one restrictor element is provided with one or more flow channels.

7. A method for controlling a return flow of drilling fluid from a bore hole comprising the step of using a restrictor element resembling a drill-pipe/casing protector (DPP) in the restrictor device of claim 1 to control the return flow in the drilling-fluid flow path formed by the annulus and the drilling-fluid return line extending from the riser below the restrictor device.

* * * * *